US010121576B1

(12) United States Patent
Frazier

(10) Patent No.: US 10,121,576 B1
(45) Date of Patent: Nov. 6, 2018

(54) PRESSURE BASED, MECHANICAL AMPERAGE CONTROL ENGINE FOR AN ELECTRONIC DEVICE

(71) Applicant: Paul Elbert Frazier, Little Rock, AR (US)

(72) Inventor: Paul Elbert Frazier, Little Rock, AR (US)

( * ) Notice: Subject to any disclaimer, the term of this patent is extended or adjusted under 35 U.S.C. 154(b) by 1010 days.

(21) Appl. No.: 14/324,181

(22) Filed: Jul. 5, 2014

Related U.S. Application Data

(60) Provisional application No. 61/843,313, filed on Jul. 5, 2013.

(51) Int. Cl.

| | |
|---|---|
| ***H01C 10/12*** | (2006.01) |
| ***H01C 10/20*** | (2006.01) |
| ***H01C 10/26*** | (2006.01) |

(52) U.S. Cl.
CPC ..... *H01C 10/12* (2013.01); *H01C 10/20* (2013.01); *H01C 10/26* (2013.01)

(58) Field of Classification Search
CPC ..... H01C 10/12; H01C 10/20; H01C 10/26
USPC ..... 307/120
See application file for complete search history.

*Primary Examiner* — Hal Kaplan
(74) *Attorney, Agent, or Firm* — Stephen D. Schrantz; Schrantz Law Firm, PLLC

(57) ABSTRACT

The pressure based control engine directs the amount of amperage that is applied to an electric device, such as a flashlight. The control engine provides a first piston body and a second piston body that conduct electricity. A piston divider constructed from a quantum tunneling material separates the first piston body and the second piston body. Compression of the piston divider by the first piston body and the second piston causes the piston divider to conduct electricity. As the pressure increases, the current that can flow through the piston divider also increases. Similarly, as the pressure decreases, the current that can flow through the piston divider decreases.

20 Claims, 17 Drawing Sheets

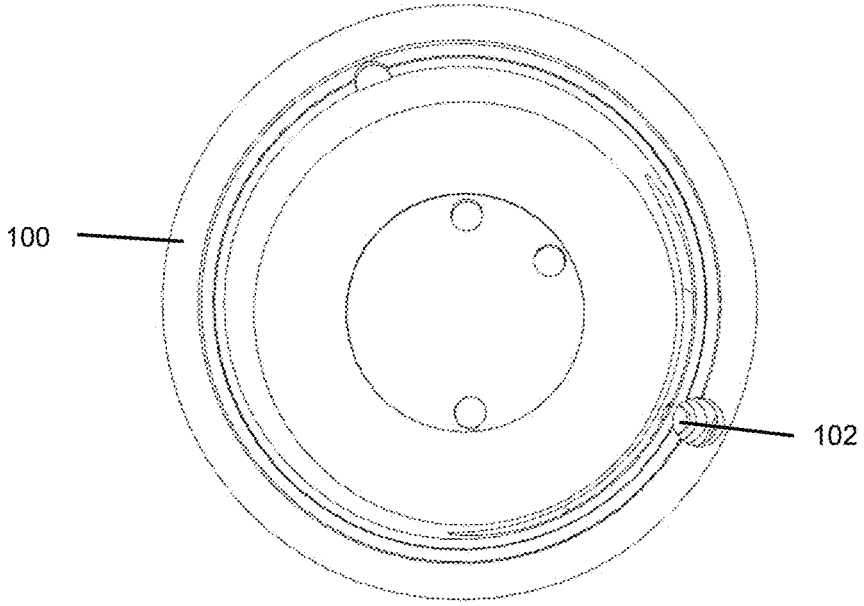
FIG. 1.1
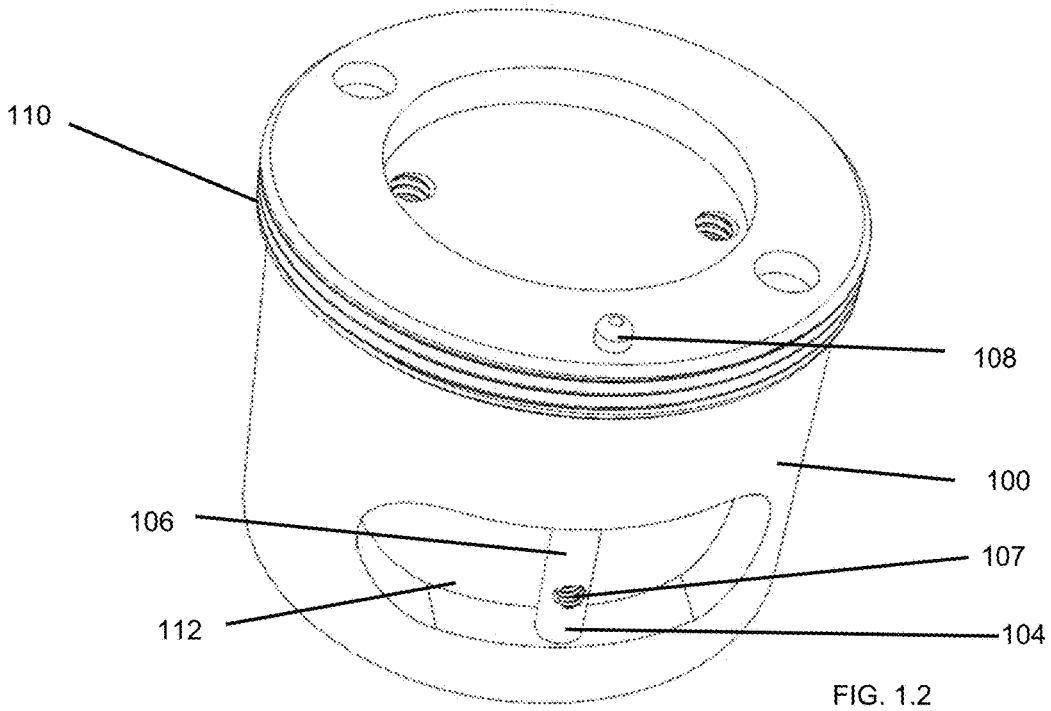
FIG. 1.2

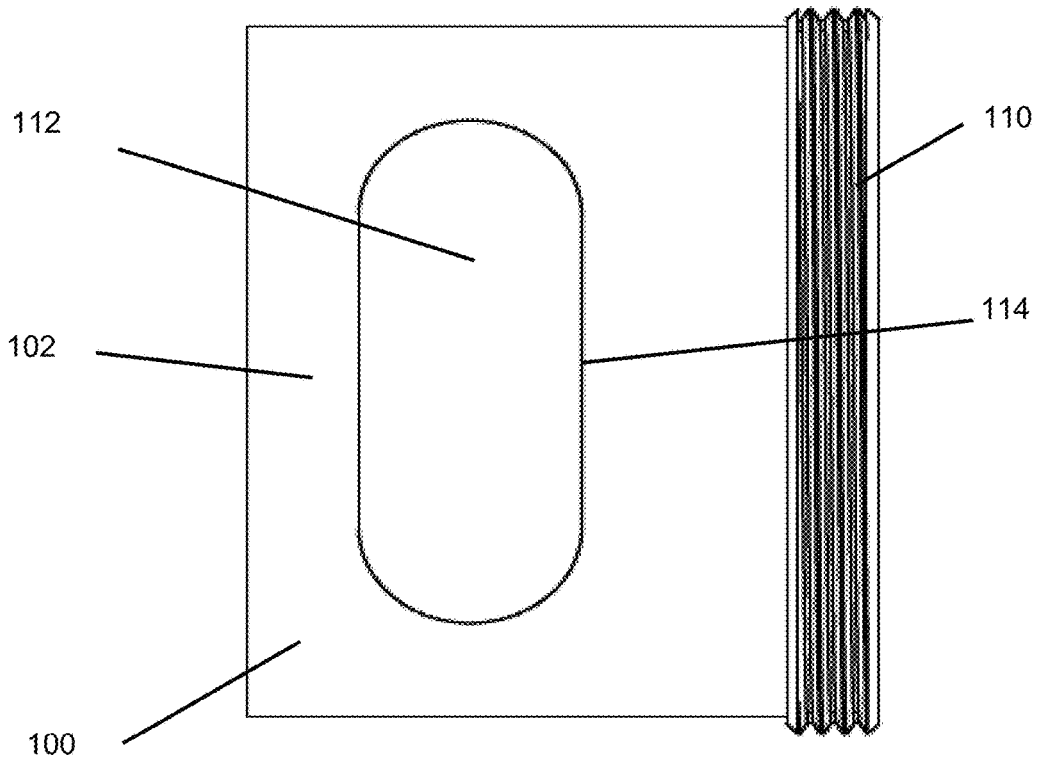
FIG. 1.3
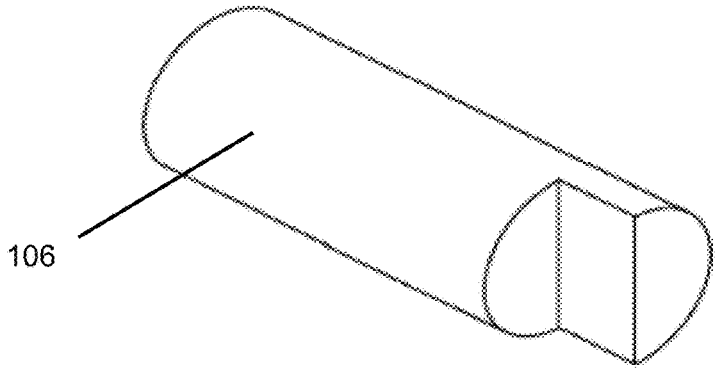
FIG. 2

PRESSURE BASED, MECHANICAL AMPERAGE CONTROL ENGINE FOR AN ELECTRONIC DEVICE

CROSS-REFERENCE TO RELATED APPLICATIONS

This application claims priority to and is a continuation-in-part of U.S. Patent Application No. 61/843,313 filed on Jul. 5, 2013 entitled PRESSURE BASED, MECHANICAL AMPERAGE CONTROL ENGINE FOR AN ELECTRONIC DEVICE which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

FIELD OF THE INVENTION

The present invention is in the field of a control engine for an electronic device.

BACKGROUND OF THE INVENTION

Typical electronic devices, such as an LED flashlight or cordless drill, will often have a control system that allows for variable output. For the LED flashlight, this control system can change the brightness level similar to the manner in which a drill spins faster with a firmer trigger pull. This output change is usually accomplished with electronic components such as a PCB (Printed Circuit Board) to control the feed of the electricity (in this case amperage) from the power source.

Electronic devices, especially those that operate in harsh environments and with heavy use, require durability and simplicity in order to function dependably and with longevity. The present invention allows for the variable output control of an electronic device without the use of a Printed Circuit Board. Thus, the present invention provides a durability advantage by eliminating the fragile PCB and adds simplicity by greatly reducing the number of solder points and parts in the device.

SUMMARY OF THE INVENTION

The present invention provides a pressure based control system for controlling the amperage supplied to an electric device. More particularly, the present invention may control the amperage applied to a flashlight. Using mechanical, pressure-based control of amperage for operation of an electronic device offers new options in durability and simplicity.

The present invention allows a user to select amperage control with a twist of the device. Tightening the device with a twisting motion increases the amperage feed to the device. Twisting the opposite direction decreases the amperage feed. The added benefit of this invention is that it allows the user to have this variable control in an electronic device without the use of a printed circuit board. The mechanical nature of the piston system achieves a level of durability and simplicity that is very useful for a device that operates under stress.

The piston system enables the flow of electricity through a piston divider constructed from a quantum tunneling material, a substance that reacts to pressure to allow current to flow through the material. As the pressure increases on the material, the amount of electricity that passes through the piston divider increases. As the pressure decreases on the material, the amount of electricity that passes through the piston divider decreases. The piston system is stored within an engine housing that enables movement of the pistons to increase the pressure on the quantum tunneling material. As the pressure increases, the electricity flows from the electrical source, such as a battery source, to the device for operation.

It is an object of the present invention to provide a more durable amperage control of a device.

It is also an object of the present invention to eliminate the need for a PCB.

It is also an object of the present invention to reduce shearing forces on the quantum material.

It is also an object of the present invention to reduce the pressure applied to the power source.

It is also an object of the present invention to provide a back up connection to ensure operation of the device.

These and other objects of the invention will be best understood when reference is made to the drawings and the description herein below.

BRIEF DESCRIPTION OF THE DRAWINGS

FIG. 1.1 is a top view of one embodiment of the engine of the present invention.

FIG. 1.2 is a bottom perspective view of one embodiment thereof;

FIG. 1.3 is a side view of one embodiment thereof

FIG. 2 is a side view of the upper piston of one embodiment of the present invention;

The drawings will be best understood when reference is made to the description and claims which follow herein below.

DESCRIPTION OF THE INVENTION

The present invention allows for the variable output control of an electronic device without the use of a Printed Circuit Board. The present invention operates by implementing a piston divider constructed from a quantum tunneling material that acts as a variable resistor reacting to pressure. This piston divider is isolated between two pistons that complete an electric circuit. The pistons are designed to protect the piston divider, keep it in place, and vary its thickness by adding and reducing pressure. The more the pistons compress the material, the more amperage is allowed into the electric device.

When pressure on the piston divider is reduced, amperage decreases. The piston divider must be kept well protected to preserve its function. The housing maintains the safety and integrity of the material. Furthermore, the housing eliminates the shearing forces of twisting. The housing also reduces the direct pressure on a battery or power source.

A detailed description of the pressure-based system incorporated in an electric device such as flashlight (the same system can be used in any electronic device that is controlled by amperage flow) is described below.

Figure 25:
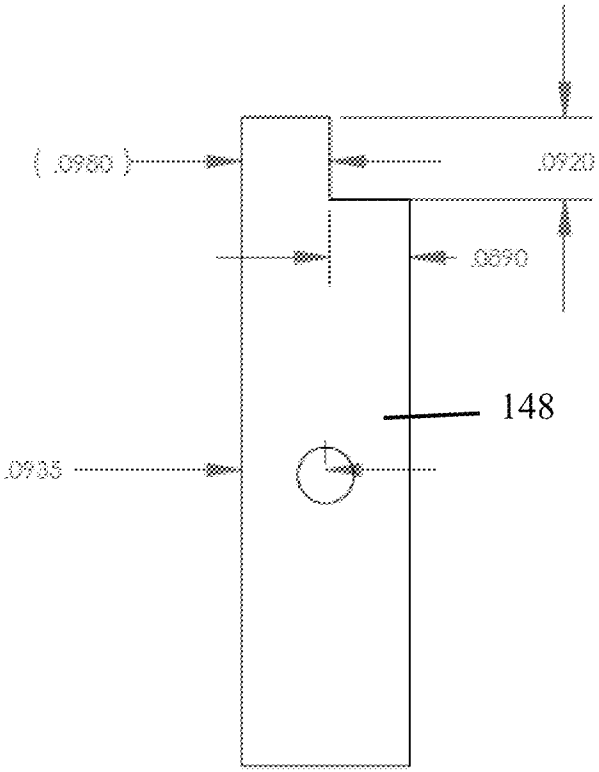
FIG. 25 is a front view of a first piston body of one embodiment of the present invention.
Figure 26:
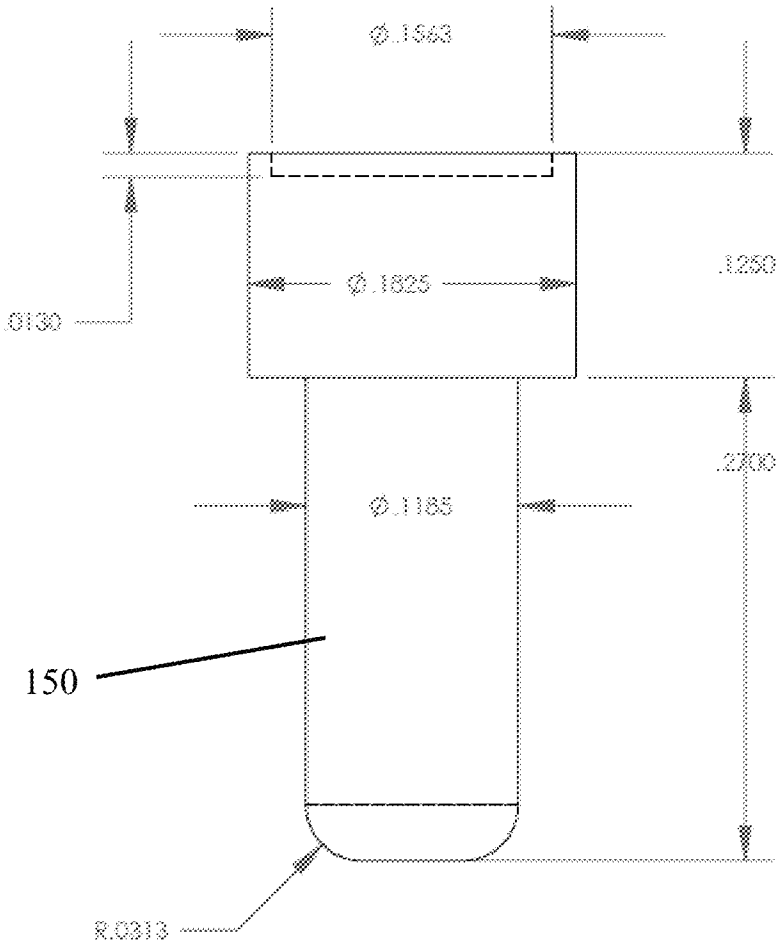
FIG. 26 is a front view of a second piston body of one embodiment of the present invention.
Figure 27:
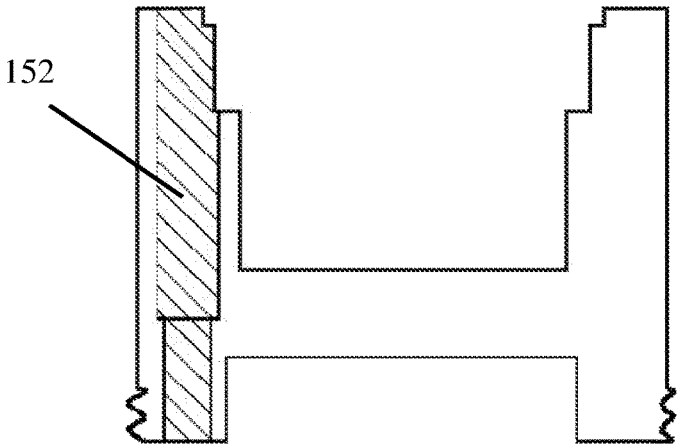
FIG. 27 is a sectional view of a piston housing of one embodiment of the present invention.
Figure 28:
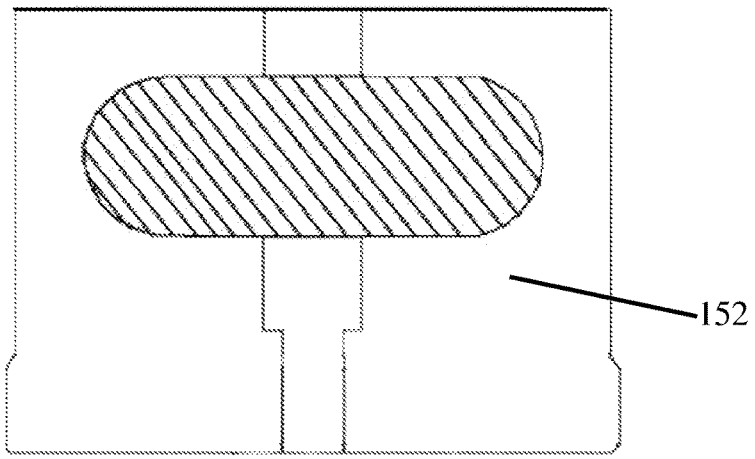
FIG. 28 is a front view thereof.
Figure 29:
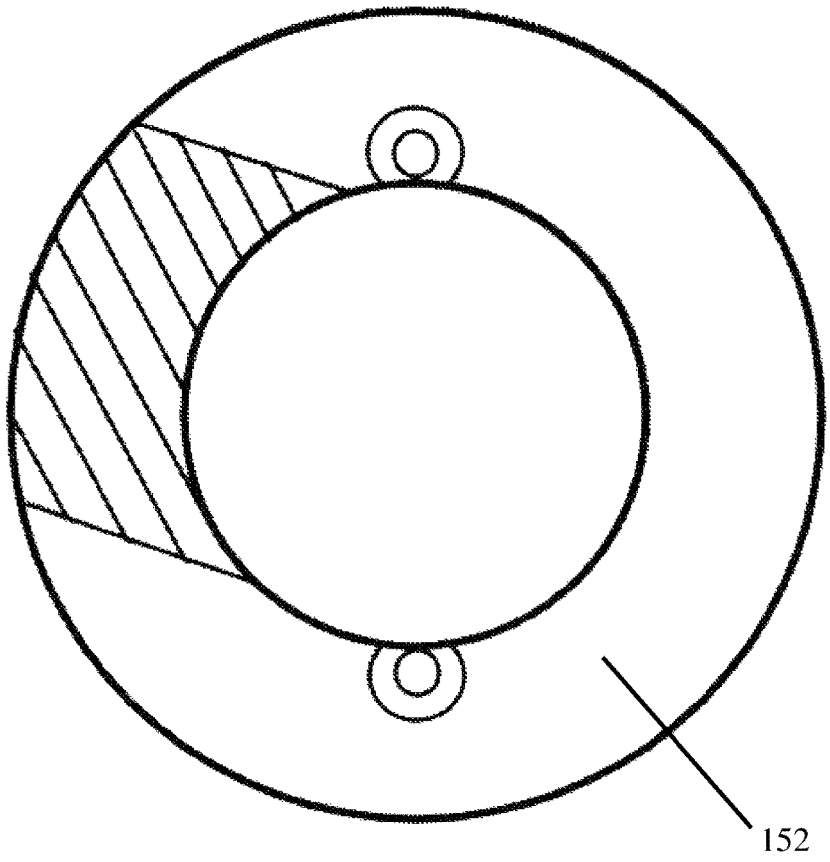
FIG. 29 is a top view thereof.
Figure 30:
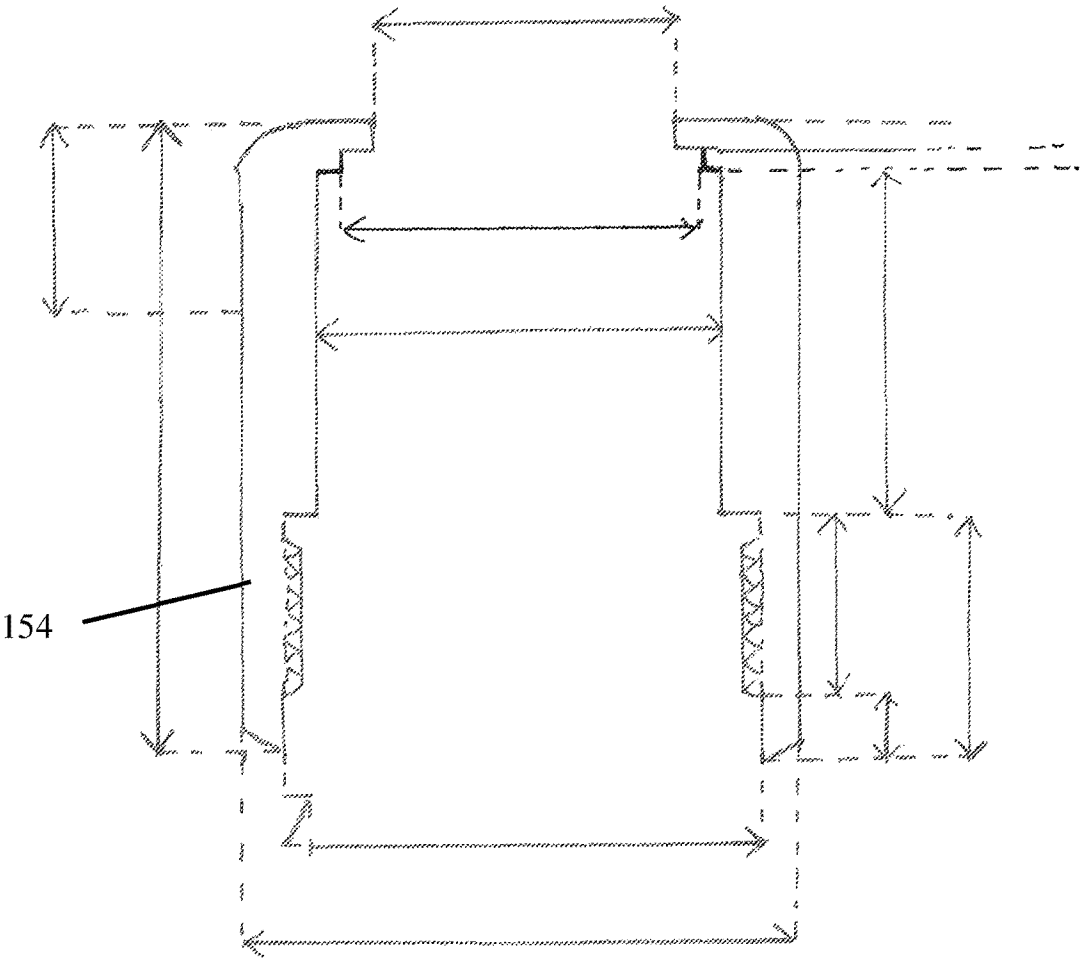
FIG. 30 is a sectional view of an engine housing of one embodiment of the present invention.
Figure 31:
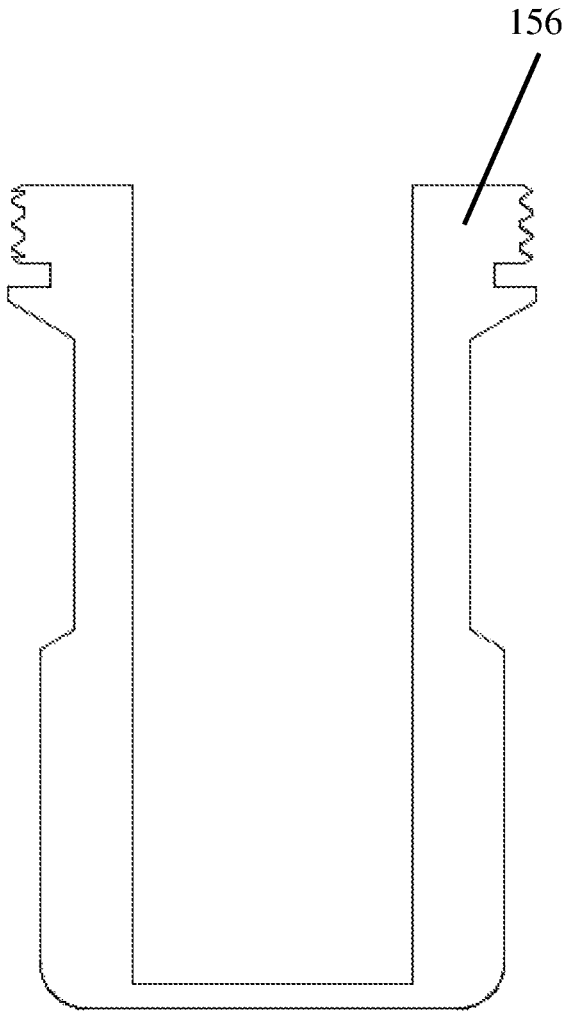
FIG. 31 is a sectional view of a power source housing of one embodiment of the present invention.
Figure 33:
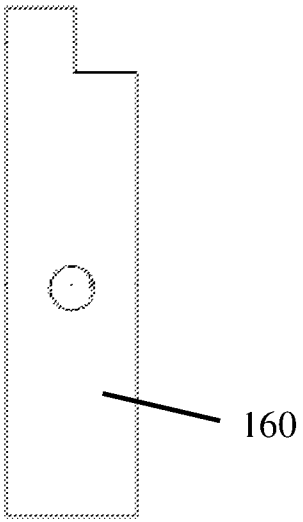
FIG. 33 is a front view of a second piston body of one embodiment of the present invention.
Figure 32:
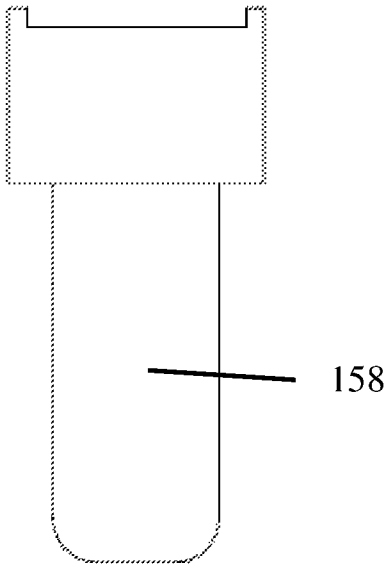
FIG. 32 is a front view of a first piston body of one embodiment of the present invention.

FIGS. 1.1-1.3 show piston housing 100 for housing the piston system 104, constructed from two piston bodies 148, 150 (see FIGS. 25-26), piston head 106, and piston bottom 108. The piston system 104 is placed within a piston aperture 102 recessed in the side wall 114 of piston housing 100. One embodiment of the piston housing 100 is non-conductive. In such an embodiment, piston housing 100 is constructed from a non-conductive material or a conductive material that is coated with a non-conductive substance. The non-conductive piston housing 100 electrically isolates the piston system 104 forcing the power source connection through the piston divider 118.

In one embodiment, the piston housing 100 is machined aluminum that has been anodized to make the surface non-conductive. The functioning parts of the light (the LED) are housed in the piston housing 100 and the electric current flows through the power source, into the piston system 102, through the LED, then back into the power source, such as a battery, to complete the circuit. The primary function of the piston housing 100 is to isolate the piston system 102 and key electric components of the device to force the electric flow through the piston system 102 and piston divider 118. Forcing the circuit through the piston divider 118 allows for a variable current depending on the pressure generated between the two pistons, piston head 106 and piston bottom 108 to the quantum tunneling material of the piston divider 118.

FIG. 1.2 is a bottom perspective view showing the piston assembly 104 installed in the piston housing 100. The Piston head 106 and Piston bottom 108 are shown in place in the piston aperture 102 of piston housing 100. The exposed Piston bottom 108 is where contact will be made with the Power Source Housing 134 to create pressure on piston divider 118. Also shown are the threads 130, which secure the piston housing 100 with the engine housing 128.

FIG. 1.2 also shows the piston head 106 and connection aperture 107. Connection aperture 107 provides an aperture for attaching a conductor such as a wire to the electric device to complete the connection from the piston assembly 104 to the device. In one embodiment, the connection aperture 107 is a threaded hole for accepting a threaded fastener to secure the conductor to the piston assembly 104 and piston head 106.

FIG. 1.3 shows a side view of the piston housing 100. Aperture 112 in the side wall 114 of piston housing 100 allows room for contact to be made between the electronic components of the device and the Upper Piston 106. Specifically, in the case of this flashlight, a wire is attached to the Upper Piston 106 from the negative lead of the LED.

FIG. 2 shows the Upper Piston 106 of one embodiment of the present invention. The upper piston 106 electrically connects to the electric ground of the device. In this case, the negative contact-point of the LED is attached to the piston system 104, more specifically the upper piston 106. The upper piston 106 stays stationary. Electricity travels through the upper piston 106 as compression is achieved on the Lower Piston 108. In one embodiment, electricity will not travel across the piston system 104 when compression is not achieved. The electric current travels through the piston divider 118 constructed from the quantum tunneling material when compression is achieved. The piston system 104 of one embodiment is constructed from brass. Other embodiments may implement a piston system 104 constructed from a different metal or other electrically conductive material. The present invention has been described as a piston head and a piston bottom. They system may also be described as a stationary piston and an adjustable piston wherein movement of the adjustable piston moves toward and away from the stationary piston to compress the piston divider 118.

Figure 3:
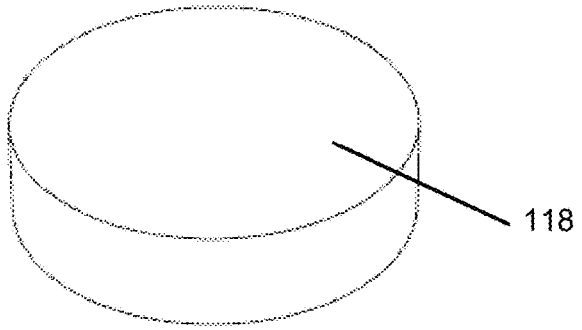
FIG. 3 is a top view of the quantum tunneling material of one embodiment of the present invention; the bottom view being a mirror image of the top view.

FIG. 3 shows the piston divider 118. In one embodiment, the piston divider 118 is constructed from a Quantum Tunneling Material, a substance that reacts to pressure to allow current to flow through the material. As the pressure that is exerted on this material increases, the material conducts more electricity through the material. As pressure decreases, the piston divider 118 expands back into its original shape, much like rubber, thus reducing the amount of current that flows through the piston divider 118. In one embodiment, the piston divider 118 is placed between the two pistons, the piston head and the piston bottom, to achieve variable user control of the electronic device, including but not limited to a the intensity of a flashlight.

Figure 4:
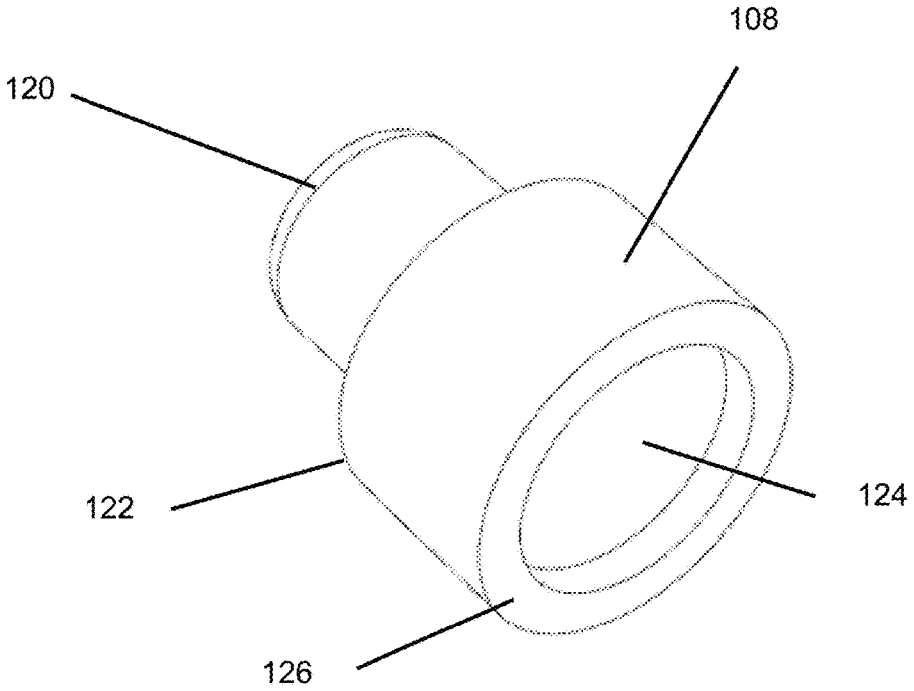
FIG. 4 is a side perspective view of the lower of one embodiment of the present invention.

FIG. 4 shows the Piston bottom 108, which is the part that moves to compress the the Quantum Tunneling Material of the piston divider 118 to create pressure and cause electricity to flow through the piston divider 118. The two-tiered shape of the piston bottom 108 allows installation of the piston divider 118 within the piston aperture 102. Piston neck 120 passes through the piston aperture 102 to allow adjustment of the piston bottom 108. The piston shoulder 122 is sized not to pass through the piston aperture 102. Piston shoulder 122 prevents piston bottom 108 from passing through the piston aperture 102.

Piston bottom 108 also provides cavity 124 for placement of the piston divider 118. Cavity 124 and lip 126 maintain the positioning of the piston divider 118. Cavity 124 and lip 126 also limit the amount of force that may be exerted on the piston divider 118 thus eliminating over-compressing the piston divider 118.

In one embodiment, such as the flashlight embodiment, the cavity 124 is 0.016" deep. The lip 126 extends outward above the cavity 124. In one embodiment, the lip 126 extends toward the piston head 106 to form a bypass in case of failure of the piston divider 118. When in full compression, the lip 126 of the piston bottom 108 comes into direct contact with the piston head 106, bypassing the piston divider 118. The lip 126 provides a fail-safe circuit in case of a complete failure of the quantum tunneling material of the piston divider 118.

Figure 5:
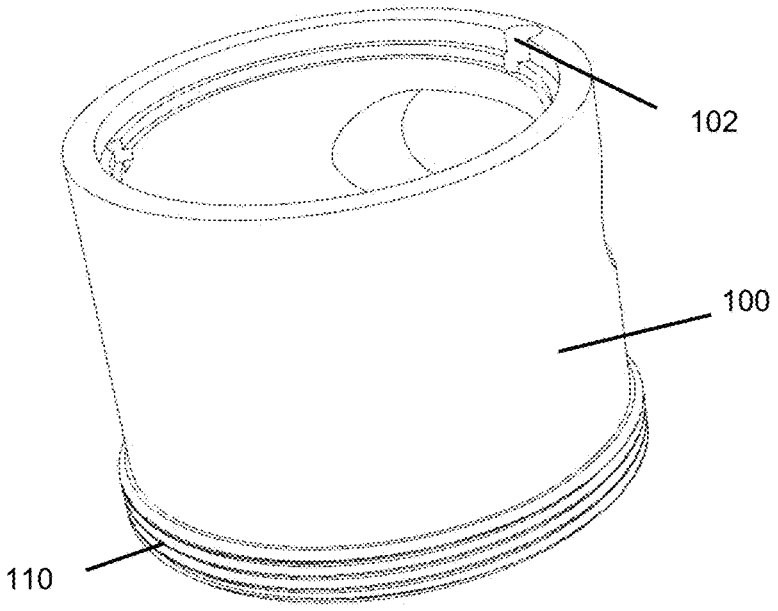
FIG. 5 is a side perspective view of the engine of one embodiment of the present invention.
Figure 6:
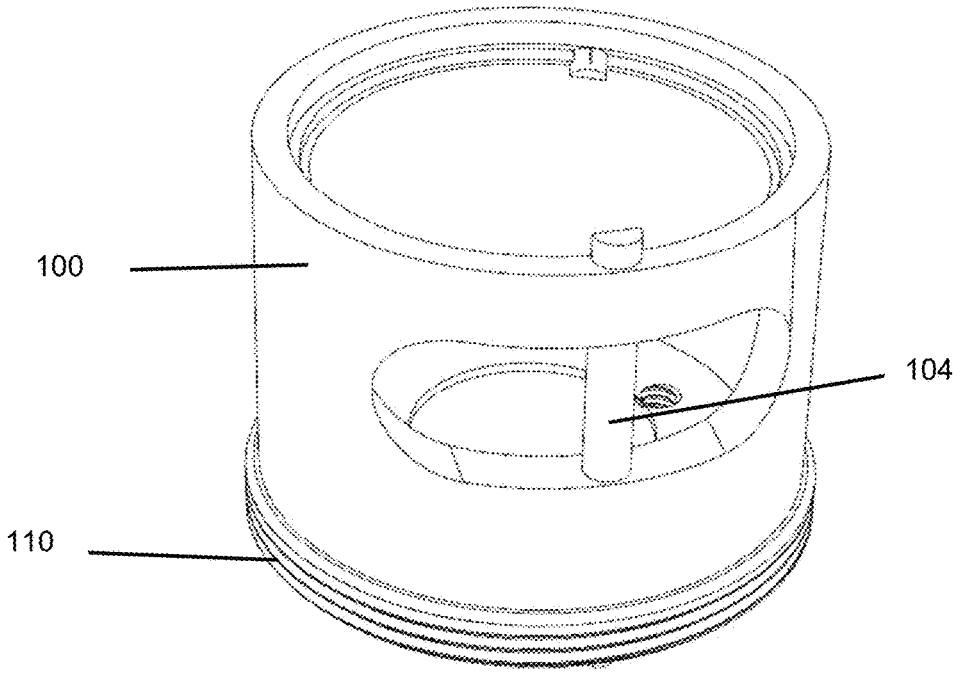
FIG. 6 is a side perspective view of the engine and pistons of one embodiment of the present invention.

FIG. 5 shows the Threading 110 on the bottom of the piston housing 100 which allows the engine to be secured within aperture 132 of the Engine Housing 128 as shown in FIG. 6. Piston housing 100 attaches to the engine hosing 128 via threads 130, 110. Engine housing 128 and piston housing 100 assembled with piston assembly 104 secures the piston assembly 104 and piston divider 118 in place and establishes the electric path to feed through the piston system 104.

Figure 7:
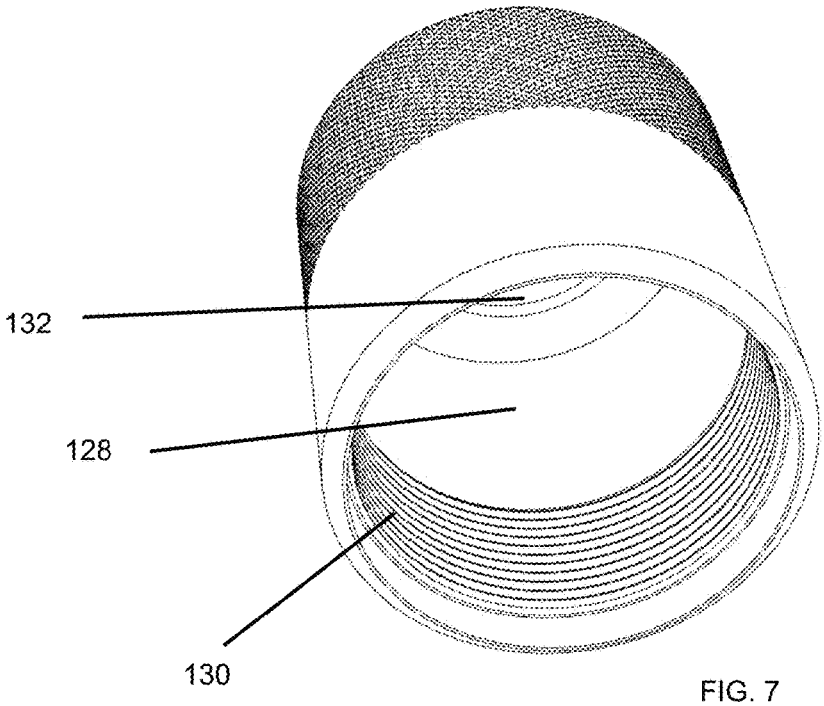
FIG. 7 is a bottom perspective view of an engine housing of one embodiment of the present invention.

FIG. 7 shows the Engine Housing 128, which at least partially encloses the piston housing 100 and secures the piston housing 100, the piston assembly 104, and piston divider 118. Engine housing 128 also provides the receiving threads 130 for securing the engine housing 128 with the power source housing 134. The threaded connection of engine housing 128 with the power source housing 134 enables rotation of the engine housing 128 and the power source housing 135. Tightening the engine housing 128 with the power source housing 134 adjusts the power source housing 134 towards the piston housing 100 and piston bottom 108. The power source housing 134 adjusts towards to contact and push the piston bottom 108, the adjustable piston, toward the piston head 106 to apply pressure to the piston system 104 and piston divider 118 by tightening the power source housing 134 on the threads 130. The threading system 130 of engine housing 128 corresponds with the threading 110 on the bottom part of the piston housing 100. Threads 110, 130 allow the piston housing 100 to be threaded into the aperture 132 of engine housing 128 and locked tightly into place. This same threading 130 also allows the Power Source Housing 138 to thread in and create pressure on the piston system 104 at the user's discretion.

Figure 8:
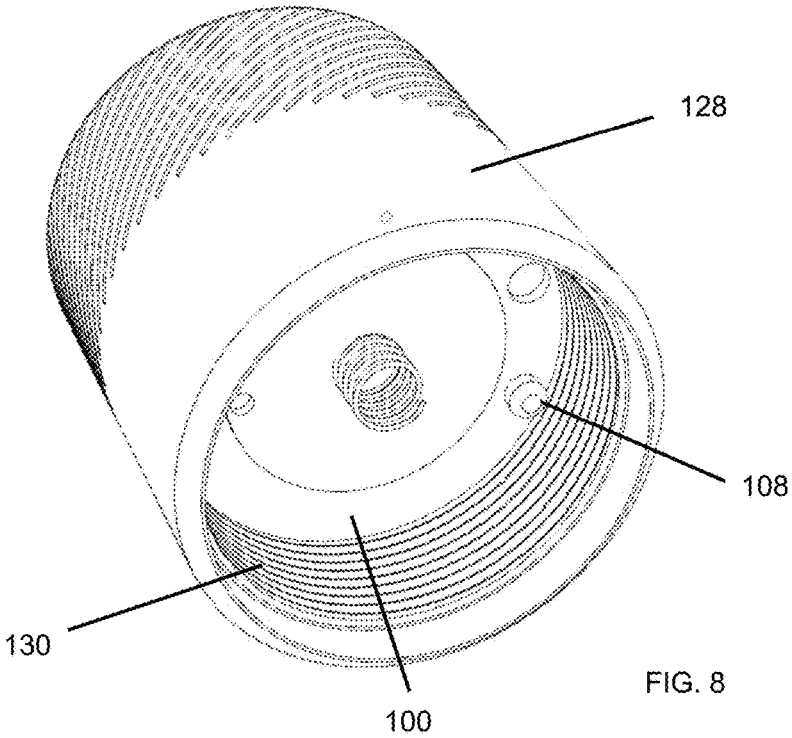
FIG. 8 is a bottom perspective view of an engine assembled within the engine housing of one embodiment of the present invention.

In FIG. 8, the piston housing 100 is secured within the engine housing 128. The piston housing 100 can be removed from engine housing 128 for repair if necessary. The fully assembled engine housing 128 with piston housing 100, piston system 104, and piston divider 118 may be secured to Power Source Housing 134 wherein the power source housing serves as an adjustment body. The piston neck 120 of piston bottom 108 extends outward from piston housing 100 thus enabling contact and adjustment of piston bottom 108. As the Power Source Housing 134 is threaded onto the engine housing 100, Contact wall 138 of the adjustment body, such as power source housing 134, contacts the piston bottom 108 to force the piston bottom 108 towards piston head 106 to compress the piston divider 118. As the power source housing 134 is loosened, the pressure on the piston bottom 108 decreases such that the compression of the piston divider 118 decreases.

Figure 9:
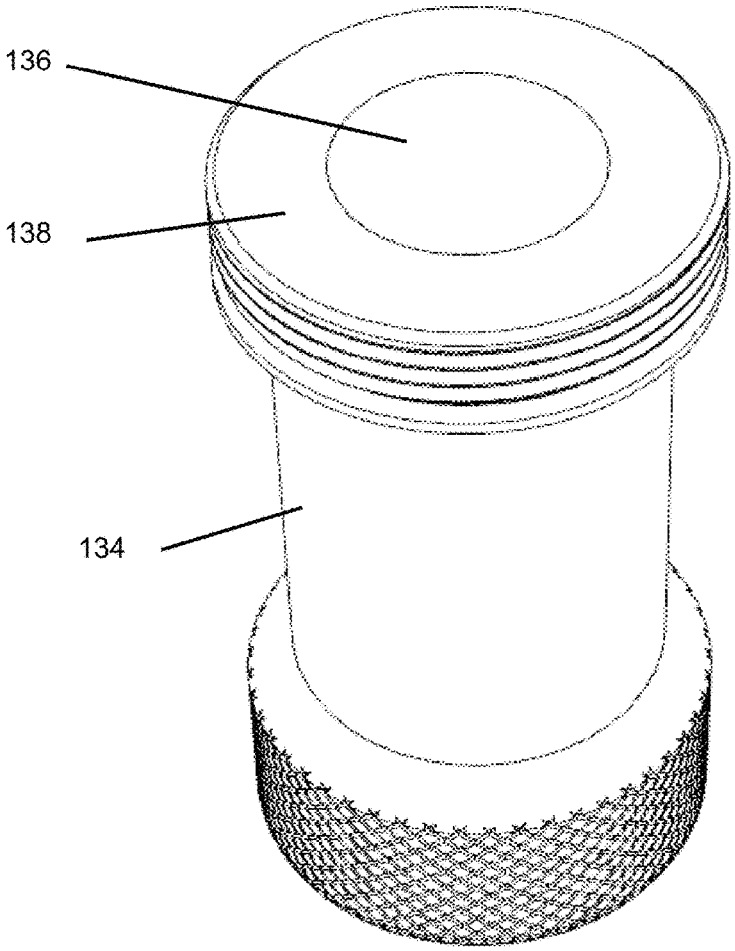
FIG. 9 is a top perspective view of a power source housing of one embodiment of the present invention.

FIG. 9 shows the Power Source housing 134, which provides the electricity to the device. In this case, power source housing 134 stores a battery in aperture 136. When the power source housing 134 is connected to the threading on the Engine Housing 128, pressure can be created on the Piston bottom 108 by tightening the connection of the engine housing 128 with power source housing 134 from twisting. Conversely, pressure is lessened by twisting the opposite direction. Contact from the piston system 104 is made on the contact wall 138 of the Power Source housing 134 and allows the current to flow from the negative end of the power source (battery), through the body of the Power Source Housing and into the piston system 104. The body of the Power Source Housing 134 acts as a conductor from the negative end of the battery, traveling to the contact wall 138. Exerting a force in mostly a linear fashion from contact of the contact wall 138 with piston bottom 108 allows for no shearing force to be exerted onto the piston system 104.

Figures 10, 11:
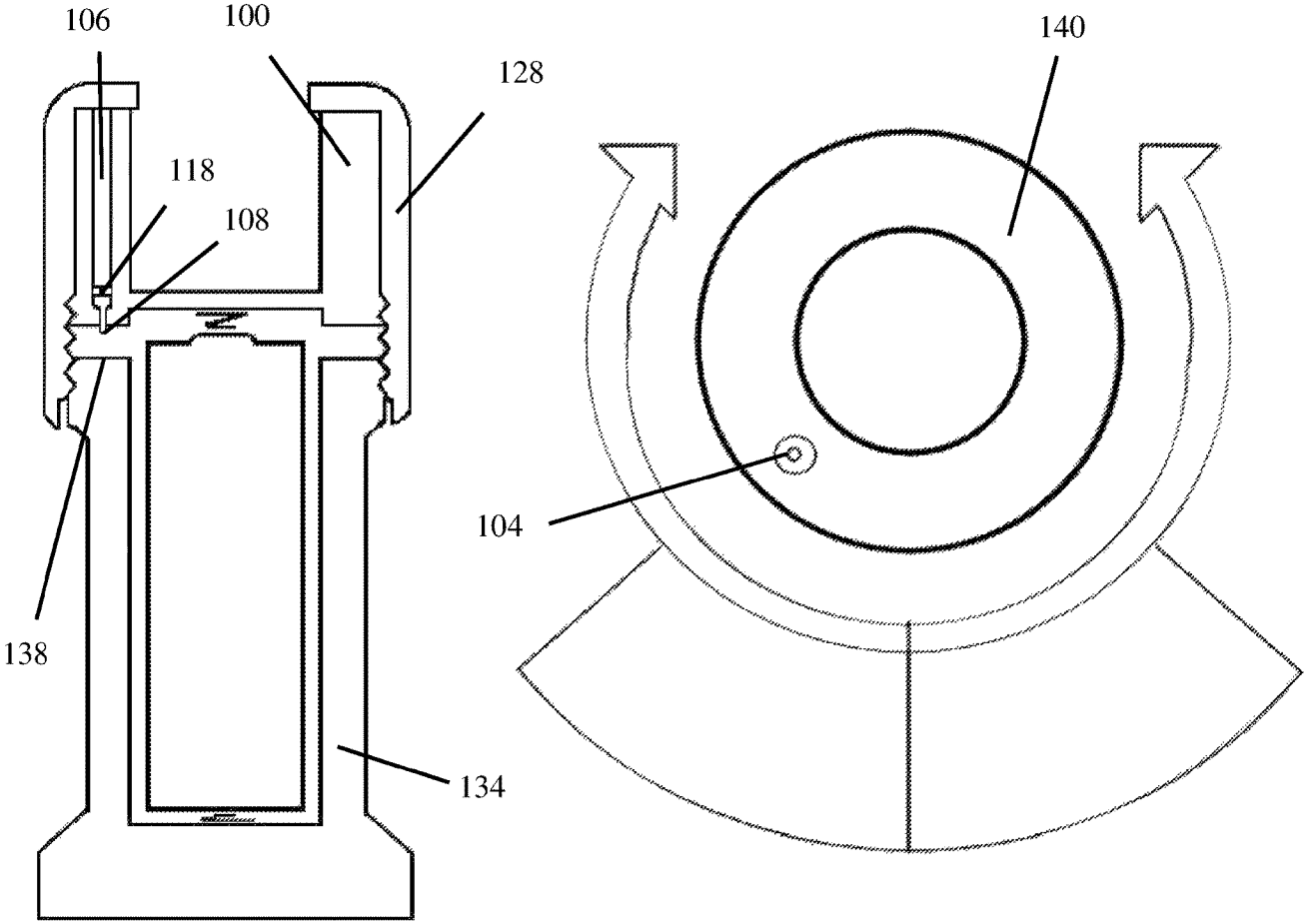
FIG. 10 is a sectional view of one embodiment of the present invention.
FIG. 11 is top view thereof.
Figure 16:
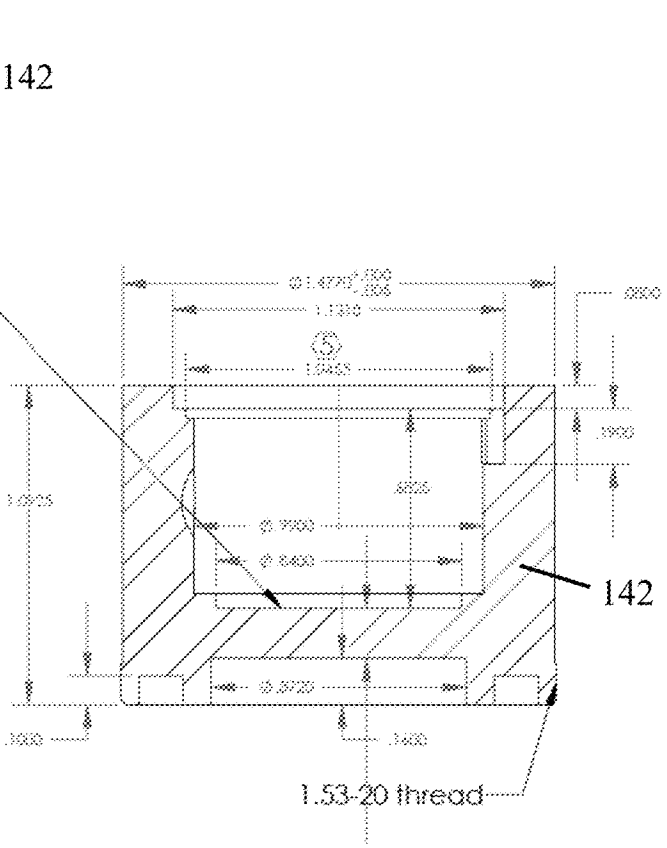
FIG. 16 is a sectional view thereof.
Figure 13:
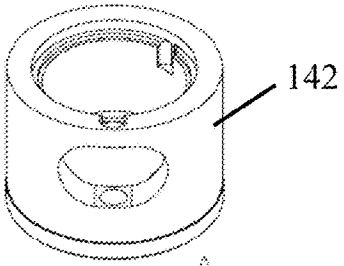
FIG. 13 is a top perspective view thereof.
Figure 15:
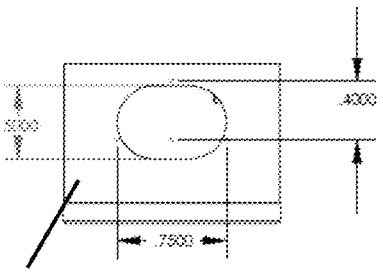
FIG. 15 is a front view thereof.
Figure 12:
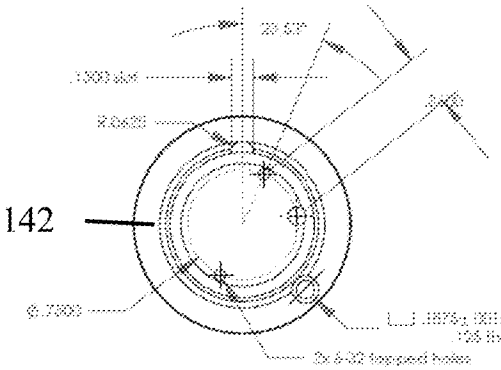
FIG. 12 is a top view of a piston housing of one embodiment of the present invention.
Figure 14:
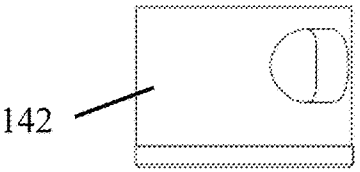
FIG. 14 is a side view thereof.
Figure 17:
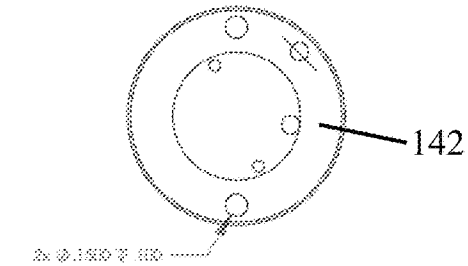
FIG. 17 is a bottom view thereof.
Figures 18, 19, 20, 21:
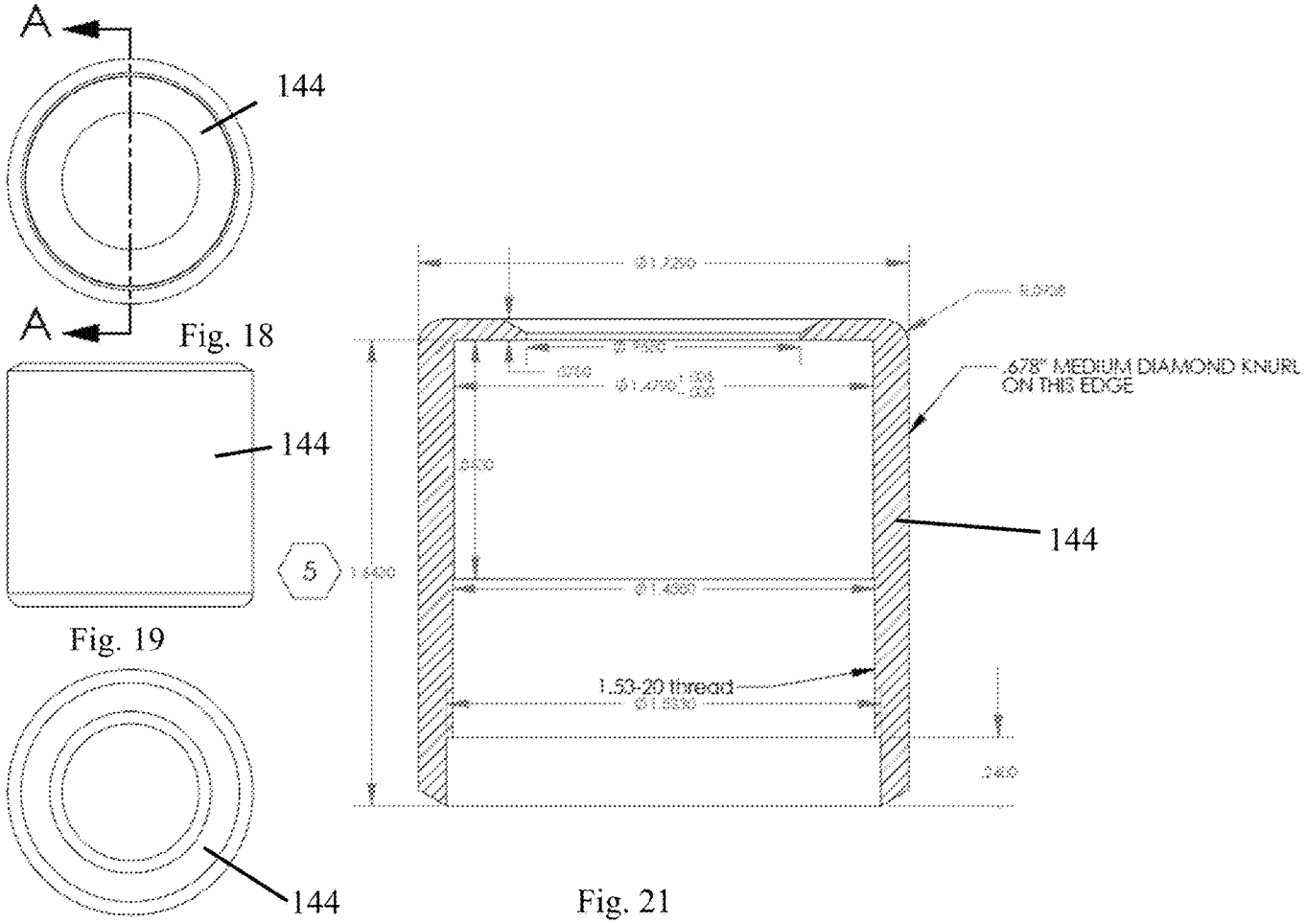
FIG. 18 is a top view of an engine housing of one embodiment of the present invention.
FIG. 19 is a front view thereof, the rear view, left side view, and right side view being a mirror image of the front view.
FIG. 20 is a bottom view thereof.
FIG. 21 is a sectional view thereof.
Figure 22:
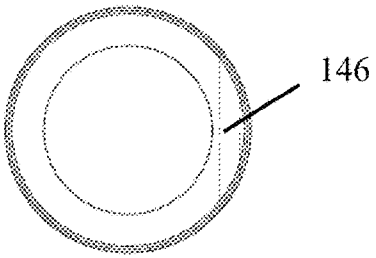
FIG. 22 is a top view of a power source housing of one embodiment of the present invention.
Figure 23:
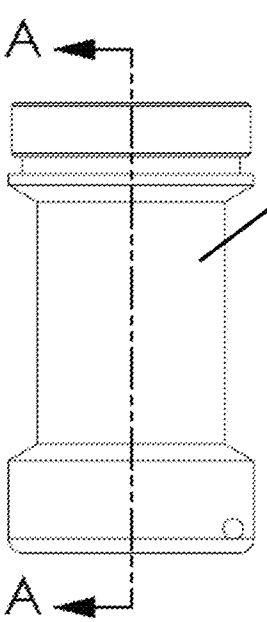
FIG. 23 is a front view thereof.
Figure 24:
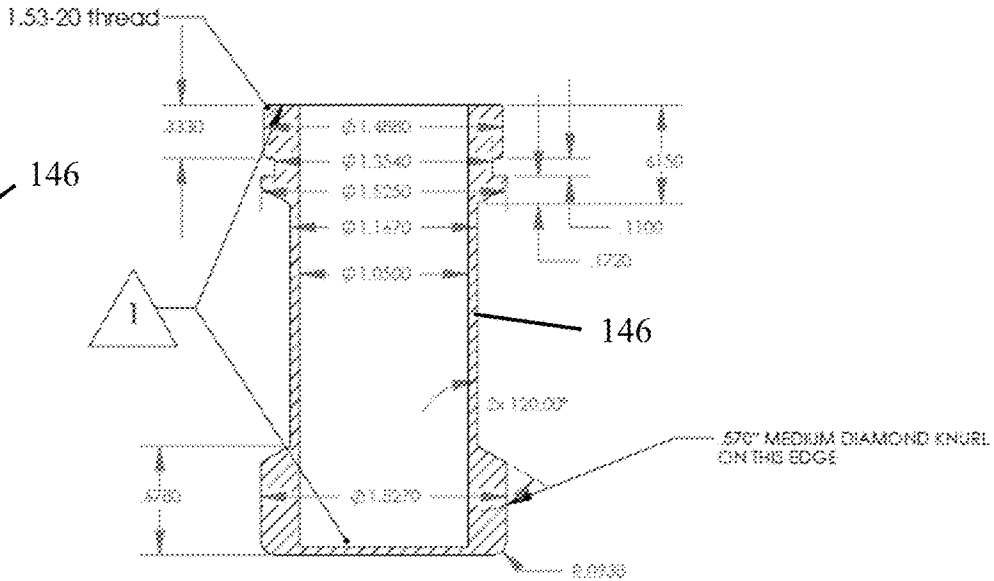
FIG. 24 is a sectional view thereof.

FIG. 10 shows a sectional view of the device showing the electrical connections and the piston housing 100, the engine housing 128, and power source housing 134 secured to each other. Contact wall 138 adjusts towards and away from piston bottom 108. The adjustment of power source housing 134 increases or decreases the compression of the piston divider 118 depending on the movement of power source housing 134. Piston bottom 108 extends outward from the piston housing 100 to enable power source housing 134 to contact piston bottom 108 and push the piston bottom 108 towards the piston head 106 to compress the piston divider 118. As stated above, loosening the power source housing 134 decreases the pressure on piston bottom 108 and piston divider 118.

FIG. 11 shows the adjustment of an adjustment body 140 such as power source housing 134 to increase the pressure applied to the piston divider 118. As the pressure applied to piston divider 118 increases, the current that flows through the piston divider 118 increases causing the light to be brighter. As the pressure applied to piston divider 118 decreases, the current that flows through the piston divider 118 decreases causing the light to be dimmer.

FIGS. 12-26 show one embodiment of the present invention and the corresponding piston housing 142, the engine housing 144, the power source housing 146, the first piston body 148, such as a piston head or top piston body, and the second piston body 150, such as the piston bottom or bottom piston body.

FIGS. 27-33 show one embodiment of the present invention and the corresponding piston housing 152, the engine housing 154, the power source housing 156, the first piston body 158, such as a piston head or top piston body, and the second piston body 160, such as the piston bottom or bottom piston body.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A control apparatus for adjustment of the amperage applied to an electric device from a power source, the apparatus comprising:

a first piston body wherein the first piston body conducts electricity and the first piston body conductively connects the power source and the electric device;

a second piston body wherein the second piston body conducts electricity, the second piston body conductively connects the power source to the electric device and the first piston body;

a piston divider located between the first piston body and the second piston body wherein the adjustment of pressure applied to the piston divider adjusts the amount of electricity conducted between the first piston body and the second piston body.

2. The apparatus of claim 1 wherein the first piston body and the second piston body apply the pressure to the piston divider to adjust the electricity conducted through the piston divider.

3. The apparatus of claim 2 wherein the first piston body and the second piston body adjust towards each other.

4. The apparatus of claim 1 further comprising:

a piston housing for storage of the first piston body and the second piston body;

a piston aperture wherein the first piston body and the second piston body are at least partially inserted into the piston aperture, the piston aperture providing access to the first piston body and the second piston body to enable exertion of a force on the first piston body and the second piston body to compress the piston divider.

5. The apparatus of claim 4 wherein the piston divider is constructed from a quantum tunneling material.

6. The apparatus of claim 1 further comprising:

an adjustment body that contacts at least one of the piston bodies to drive the piston bodies towards each other to compress the piston divider wherein the adjustment body adjusts towards and away from the first piston body and the second piston body.

7. The apparatus of claim 6 wherein the adjustment body rotates in relation to the piston housing, the adjustment body rotating to adjust the position of at least one of the piston bodies.

8. The apparatus of claim 7 wherein the rotation of the adjustment body in a first direction adjusts the first piston body towards the second piston body to compress the piston divider; and wherein rotation of the adjustment body in a second direction adjusts the first piston body away from the second piston body to reduce pressure on the piston divider.

9. The apparatus of claim 1 wherein the first piston body remains stationary and the second piston body adjusts towards and away from the first piston body.

10. The apparatus of claim 9, the second piston body further comprising:

a cavity for placement of the piston divider; and a lip forming the cavity wherein the lip conducts electricity, the lip extending towards the first adjustment body.

11. The apparatus of claim 10 wherein the piston divider installed into the cavity extends above the lip.

12. A control apparatus for adjustment of the amperage applied to an electric device from a power source, the apparatus comprising:

a first piston body wherein the first piston body conducts electricity and the first piston body conductively connects the power source and the electric device;

a second piston body wherein the second piston body conducts electricity, the second piston body conductively connects the power source to the electric device and the first piston body;

a piston divider located between the first piston body and the second piston body wherein the adjustment of pressure applied to the piston divider adjusts the amount of electricity conducted between the first piston body and the second piston body; and a piston housing for storage of the first piston body, the second piston body, and the piston divider wherein the piston housing allows adjustment of the first piston body and the second piston body towards each other to compress the piston divider.

13. The apparatus of claim 12 wherein the first piston body and the second piston body apply the pressure to the piston divider to adjust the electricity conducted through the piston divider.

14. The apparatus of claim 12 further comprising:

an adjustment body configured to contact the second piston body to direct the second piston body towards the first piston body and to compress the piston divider;

a piston aperture in the piston housing wherein the second piston body at least partially passes through the piston aperture to enable the adjustment body to contact the second piston body and direct the second piston body towards the first piston body to compress the piston divider.

15. The apparatus of claim 14 wherein the piston divider is constructed from a quantum tunneling material.

16. The apparatus of claim 14 wherein the rotation of the adjustment body in a first direction adjusts the second piston body towards the first piston body to compress the piston divider; and wherein rotation of the adjustment body in a second direction adjusts the second piston body away from the first piston body to reduce pressure on the piston divider.

17. The apparatus of claim 16, the second piston body further comprising:

a cavity for placement of the piston divider; and a lip forming the cavity wherein the lip conducts electricity, the lip extending towards the first adjustment body wherein the piston divider installed into the cavity extends above the lip.

18. A control apparatus for adjustment of the amperage applied to an electric device from a power source, the apparatus comprising:

a first piston body wherein the first piston body conducts electricity and the first piston body conductively connects the power source and the electric device;

a second piston body wherein the second piston body conducts electricity, the second piston body conductively connects the power source to the electric device and the first piston body;

a piston divider located between the first piston body and the second piston body wherein the adjustment of pressure applied to the piston divider adjusts the amount of electricity conducted between the first piston body and the second piston body;

a piston housing for storage of the first piston body, the second piston body, and the piston divider wherein the piston housing allows adjustment of the first piston body and the second piston body towards each other to compress the piston divider;

an engine housing wherein the piston housing attaches to the engine housing;

an power source housing for storage of a power source wherein the power source housing attaches to the engine housing, the power source housing contacting at least one of the piston bodies to direct the piston bodies towards each other to compress the piston divider.

19. The apparatus of claim 18 further comprising:

a threaded connection for securing the power source housing to the engine housing wherein the power source housing adjusts towards and away from the piston housing;

a piston aperture in the piston housing wherein the second piston body at least partially passes through the piston aperture to enable the power source housing to contact the second piston body and direct the second piston body towards the first piston body to compress the piston divider.

20. The apparatus of claim 19 wherein the rotation of the power source housing in a first direction adjusts the second piston body towards the first piston body to compress the piston divider; and wherein rotation of the power source housing in a second direction adjusts the second piston body away from the first piston body to reduce pressure on the piston divider.

* * * * *